United States Patent [19]

Schleicher

[11] Patent Number: 4,530,382

[45] Date of Patent: Jul. 23, 1985

[54] SHED FORMING ARRANGEMENT

[75] Inventor: Oskar H. Schleicher, Monchen-Gladbach, Fed. Rep. of Germany

[73] Assignee: Fa. Oskar Schleicher, Fed. Rep. of Germany

[21] Appl. No.: 529,549

[22] Filed: Sep. 6, 1983

[30] Foreign Application Priority Data

Sep. 10, 1982 [DE] Fed. Rep. of Germany ..... 3233547

[51] Int. Cl.[3] ..... D03C 13/00; D03C 3/20

[52] U.S. Cl. ..... 139/455; 139/59; 139/65; 139/319

[58] Field of Search ..... 139/455, 456, 55.1, 139/59, 65, 319

[56] References Cited

U.S. PATENT DOCUMENTS 3,103,953 9/1963 Lauritsen ..... 139/455
3,835,894 9/1974 Speich ..... 139/455
4,416,310 11/1983 Sage ..... 139/59

FOREIGN PATENT DOCUMENTS 510882 10/1930 Fed. Rep. of Germany ..... 139/319
2203925 8/1973 Fed. Rep. of Germany ..... 139/455
2047755 12/1980 United Kingdom ..... 139/65

*Primary Examiner*—James Kee Chi
*Attorney, Agent, or Firm*—King, Liles & Schickli

[57] ABSTRACT

A shed forming arrangement for a loom comprises lift elements which move in opposite directions to each other, with holding members arranged on each lift element. The holding members are connected together in respective pairs by connecting members each forming a loop in which a roller is carried. The roller is operatively connected to the shed forming means of the machine. The holding members are in the form of magnet armature members and are operatively associated with selectively actuable holding magnet means, thereby to control a lift movement of the respective roller.

5 Claims, 1 Drawing Figure

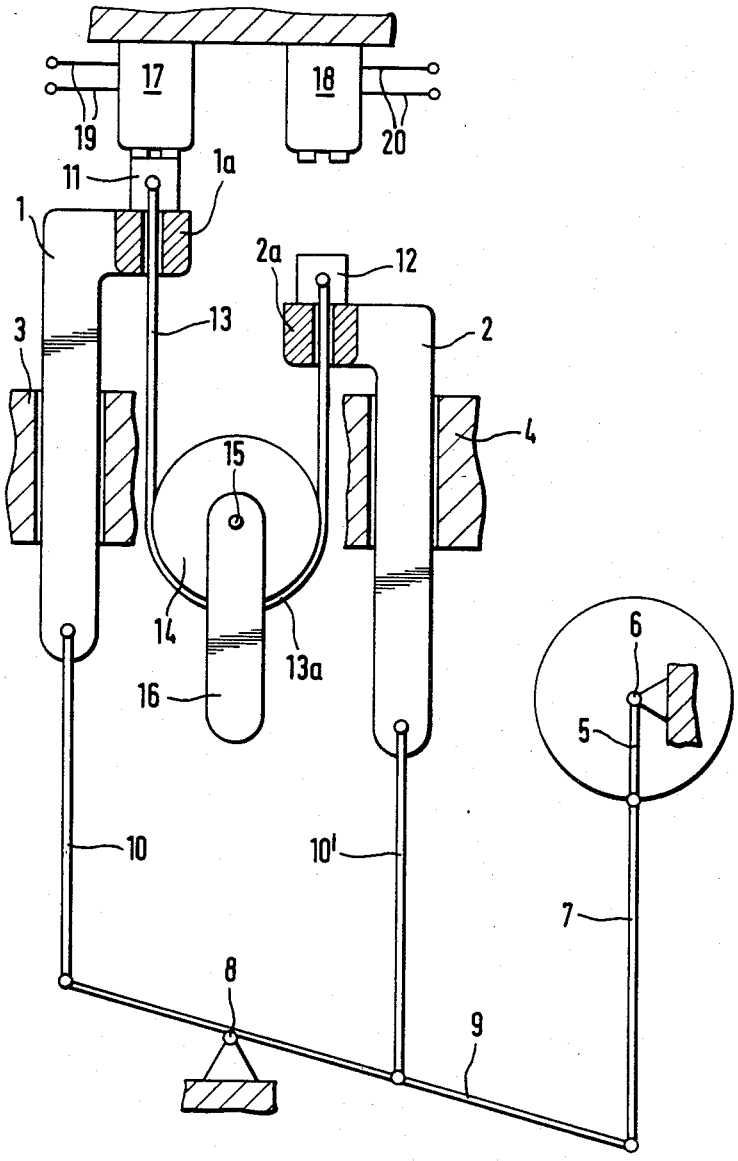
17
18
19
20
11
1a
1
2a
12
3
13
2
4
15
14
13a
16
6
5
10
10'
7
8
9

SHED FORMING ARRANGEMENT

BACKGROUND OF THE INVENTION

The invention relates generally to textile machinery such as a loom and to a shed forming arrangement for such a machine.

One form of shed forming arrangement or shedding apparatus, as disclosed for example in DE-OS (German laid-open application) No. 22 04 815, comprises lift elements which are so arranged as to be movable in opposite directions, with holding members which are disposed on the lift elements. The holding members are joined together in pairs by respective connecting members which each form a loop, a roller being carried in each said loop and acting on the shaft draw means or harness draw means of the textile machine. The above-mentioned holding members which are carried on the respective lift elements are in the form of draw hooks, and associated therewith are retaining hooks which can be pivoted into the path of movement of the hooks forming the holding members. Pivotal movement of the retaining hooks is produced, in one direction, by electromagnetic means, while in the other direction it is effected by compression springs. That arrangement can be controlled by actuation of the electromagnetic means, and therefore does not involve using the conventional Jacquard cards. However, that arrangement suffers from the serious disadvantage that it includes a large number of movable components, so that it is complicated in construction and also tends to suffer from a high rate of wear. There is also the problem that the above-discussed arrangement takes up a great deal of space.

SUMMARY OF THE INVENTION

An object of the present invention is to provide an improved shedding apparatus.

Another object of the present invention is to provide a shedding arrangement which has a reduced number of movable components, thereby reducing the structural and operational complexity of such an arrangement.

Yet another object of the present invention is to provide a textile machine shedding apparatus which is of a compact construction.

Still another object of the present invention is to provide a shedding apparatus which is of such a design as to have a low power requirement.

Still a further object of the present invention is to provide a shedding arrangement which is of such a design as to produce a small amount of heat in operation thereof.

These and other objects are achieved by a shed forming arrangement for a textile machine, which comprises lift elements which are movable in opposition to each other, and holding members arranged on each thereof. The holding members are interconnected to form respective pairs, by a respective flexible connecting member defining a loop configuration, such as a cable or similar. The loop carries a roller which acts on the shaft draw means or harness draw means of the textile machine. Associated with the holding members are holding magnet means which are selectively operable by way of programming means. For that purpose, the holding members are each in the form of a magnet armature. It will be seen hereinafter that, by virtue of the direct magnet actuation of the holding members, and thus therewith the lift elements, which is achieved in accordance with the principles of the invention, the apparatus requires a substantially smaller number of movable members than the previous arrangement discussed in the opening part of this specification. In addition, the apparatus when constructed in accordance with the principles of this invention can be of a more compact and space-saving design.

The holding magnets may be in the form of electromagnet or solenoid means or, in another embodiment which is particularly advantageous, the holding magnets may each be in the form of a permanent magnet, with demagnetisation means such as a demagnetisation winding. That form of the construction in accordance with the present invention provides an apparatus which is of such a design as to have a low level of power consumption, thereby saving energy, while on the other hand also producing a smaller amount of heat in operation thereof. With that construction, the demagnetisation winding for the respective permanent magnet which is to be rendered inoperative with regard to holding the respective holding member co-operable therewith is to be supplied with current only for the phase of operation of the apparatus, in which the holding members, being in the form of magnet armatures, are to be released from the respective permanent magnets, as required.

Further objects, features and advantages of the construction in accordance with the present invention will be more clearly apparent from the following detailed description of a preferred embodiment of the invention.

BRIEF DESCRIPTION OF THE DRAWING

The accompanying single FIGURE of drawing shows a diagrammatic view of a shedding arrangement for a double-lift open-shed Jacquard machine.

DESCRIPTION OF THE PREFERRED EMBODIMENT

Referring therefore to the drawing which shows the part of a loom constituting a portion of a shed forming arrangement for a double-lift open-shed Jacquard machine, the shed forming arrangement illustrated comprises first and second lift elements 1 and 2 which are arranged in respective stationary guide means 3 and 4 in such a way that the lift elements can perform a vertical lift movement. For the purposes of producing the appropriate lift movement, the machine includes a crank arrangement 5 which is suitably driven by a drive means (not shown) and which is mounted for pivotal movement about a pivot as indicated at 6, which is stationary with respect to the frame of the machine. The crank arrangement 5 is connected to the respective lift elements 1 and 2 by way of a linkage arrangement, more specifically, a linkage rod 7 which has a first end pivotally connected to the crank arrangement 5 and a second end pivotally connected to a further linkage rod 9 which is mounted for pivotal movement about a pivot 8 which is fixed with respect to the frame of the machine. Pivotally connected to the rod 9, at respective sides of the stationary pivot 8, are crank levers 10 and 10' which have their other ends pivotally connected to the lower end portions (as viewed in the drawing) of the lift elements 1 and 2. Thus, actuation of the crank arrangement 5, by way of the linkage arrangement 7 through 10, 10', will cause the lift elements 1 and 2 to perform a lift movement in opposite directions relative to each other.

At their upper ends as viewed in the drawing, each of the lift elements 1 and 2 has a bent portion as indicated at 1*a* and 2*a* respectively. Disposed above the bent portions 1*a* and 2*a* are respective magnet armature members 11 and 12. Secured to the magnet armature members 11 and 12 are respective ends of a flexible connecting member which is illustrated in the form of a cable or line 13. The cable 13 is so arranged as to form a loop as indicated at 13*a*, and a roller or wheel 14 is carried in the loop. The spindle 15 of the roller 14 is connected to a member 16 which is formed for example as a shaft draw means or harness draw means and thus as a shed forming means of the loom (not shown).

Mounted above the magnet armature members 11 and 12 are respective stationary holding magnets 17 and 18 which may be in the form of electromagnetic units or permanent magnets having demagnetisation windings 19 and 20 respectively. Current supply to and thus control of the magnets 17 and 18 is effected from a program carrier or suitable programming means (not shown).

It will be seen therefore that the members 11 and 12 may be selectively retained in a position in which they are held to the holding magnet units 17 and 18 respectively, with the cable 13 passing through holes in the bent portions 1*a* and 2*a* of the respective lift elements 1 and 2, in such a way that the cable can pass freely therethrough, as required.

Having described the basic construction of the arrangement according to the present invention, the mode of operation thereof will now be described:

Starting from the position illustrated in the drawing, upon a downward movement of the element 1, the magnet armature member 11 remains in the position illustrated, in which it is connected to the unit 17, if the demagnetisation winding 19 thereof is not supplied with power. If in contrast the demagnetisation winding 19 is supplied with power upon such downward movement of the element 1, then the permanent magnet 17 will be demagnetised and the armature member 11 will be released, to move downwardly with the element 1.

In the first situation, that is to say, when the armature member 11 remains connected to the unit 17, the roller 14 will move upwardly, relative for example to the guide means 3 and 4, as when the element 1 moves downwardly, the element 2 is at the same time moved upwardly and thus carries the armature 12 therewith. That will then of course result in a corresponding upward movement of the roller 14, its spindle 15 and thus the member 16.

If, as in the second situation referred to above, the demagnetisation winding 19 is operable, so that the armature member 11 is released from the magnet unit 17, then, in the subsequent movement of the element 1, the roller 14 and therefore also its spindle 15 and the member 16 connected thereto will remain at the same level as that illustrated, as in such a situation, as the element 2 moves upwardly, thus entraining the armature member 12 and the cable 13, the portion of cable 13 on the left-hand side of the roller 14 will move downwardly by the same amount as the portion of cable 13 on the right-hand side of the roller 14 is moved upwardly. There will therefore be no actuation of the shed forming means.

It will be seen therefore that the above-described arrangement provides for control of the shed forming means of a loom, in an extremely simple manner, with a small number of movable components and a compact construction. It is also found that the above-described arrangement in accordance with this invention has a low level of power consumption, and also develops a small amount of heat.

The above-described embodiment was given by way of example only of a construction in accordance with the principles of this invention, and various alterations and modifications may be made therein, without thereby departing from the spirit and scope of this invention.

What is claimed is:

1. A shed forming arrangement for a textile machine, including first and second lift elements movable in opposition to each other, a respective holding member in the form of a magnet armature member on each said lift element; said holding members being relatively moveable with respect to said lift elements and connected together to form a respective pair by a connecting member forming a loop, a roller carried in the loop, means for connecting the roller to shedding means of the machine, and first and second holding magnets co-operable with respective ones of the holding members and actuable by program means to selectively retain said respective holding members away from said lift elements.

2. An arrangement as set forth in claim 1 wherein each said holding magnet is in the form of an electromagnet means.

3. An arrangement as set forth in claim 1 wherein each said holding magnet is in the form of a permanent magnet means with demagnetisation means.

4. A shed forming arrangement for a loom, comprising: first and second lift elements, each having a first end and a second end; guide means slidably carrying said lift elements; drive means connected to the first ends of the first and second lift elements and operable to cause the lift elements to move in opposition to each other in said guide means; first and second holding members forming magnet armature means supported on the second ends of the respective said lift elements and adapted to be selectively lifted away therefrom; a flexible connecting member interconnecting the holding members and defining a loop therebetween; a roller carried in said loop and providing means for connection to shedding means of the loom; and first and second holding magnet means operably selectively to retain or release said first and second holding members respectively upon movement of said lift elements in said guide means, thereby selectively to produce a shedding motion of said roller.

5. In a loom, a shed forming arrangement comprising first and second lift elements, means adapted to move said lift elements in opposition to each other, holding members in the form of respective magnet armature means arranged on each of said first and second lift elements, a connecting member connecting said holding members together to define the respective pair thereof, said connecting member forming a loop configuration, a roller carried in the loop configuration defined by said connecting member and operative to act on shed means of the loom, first and second holding magnet means operatively associated with the holding members, and program carrier means for selectively actuating said holding magnet means, thereby selectively to enable or disable movement of said holding members downwardly with said lift elements.

* * * * *